US008526839B2

(12) United States Patent
Fujinaga

(10) Patent No.: US 8,526,839 B2
(45) Date of Patent: Sep. 3, 2013

(54) IMAGE FORMING APPARATUS INCLUDING A PRINTING APPARATUS WITH A PLURALITY OF TRAYS FOR PRINTING ONE GROUP AND OUTPUTTING TO THE PLURALITY OF TRAYS

(75) Inventor: Seiya Fujinaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 12/964,563

(22) Filed: Dec. 9, 2010

(65) Prior Publication Data

US 2011/0211888 A1 Sep. 1, 2011

(30) Foreign Application Priority Data

Feb. 26, 2010 (JP) ..... 2010-041660

(51) Int. Cl.
*G03G 15/00* (2006.01)

(52) U.S. Cl.
USPC ..... 399/81

(58) Field of Classification Search
USPC ..... 399/81, 405
See application file for complete search history.

(56) References Cited

U.S. PATENT DOCUMENTS

| | | | | |
|---|---|---|---|---|
| 4,501,419 | A | 2/1985 | Takahashi | |
| 5,435,544 | A * | 7/1995 | Mandel | 271/298 |
| 5,547,178 | A * | 8/1996 | Costello | 270/52.02 |
| 7,016,059 | B1 * | 3/2006 | Baum et al. | 358/1.15 |
| 7,184,163 | B2 * | 2/2007 | Munakata et al. | 358/1.15 |
| 2006/0033955 | A1 * | 2/2006 | Munakata et al. | 358/1.15 |
| 2008/0159769 | A1 * | 7/2008 | Sato et al. | 399/80 |
| 2009/0153916 | A1 * | 6/2009 | Borsuk et al. | 358/474 |
| 2011/0211009 | A1 * | 9/2011 | Fujinaga | 347/16 |

FOREIGN PATENT DOCUMENTS

| | | |
|---|---|---|
| CN | 101211152 A | 7/2008 |
| JP | 09-295748 A | 11/1997 |

* cited by examiner

*Primary Examiner* — G. M. Hyder
(74) *Attorney, Agent, or Firm* — Canon USA Inc. IP Division

(57) ABSTRACT

An image forming apparatus arranged to produce groups of printed sheets. Each group includes a plurality of sequential sheets. The image forming apparatus includes a plurality of storage units each configured to store the printed sheets produced by an image forming unit, a sorter unit configured to sort the printed sheets of a group into a plurality of portions, wherein the sheets in each portion are in sequential order, and to output each of the portions to a different storage unit, and a display unit configured to display an indication of the storage unit storing the portion including the first or the last sheet of the group such that a user is directed to collect the portion including the first or the last sheet of the group from the indicated storage unit first.

14 Claims, 16 Drawing Sheets

| ID | STATUS | PRINTING | OUTPUT SORTER | INPUT DATE AND TIME | PRIORITY |
|---|---|---|---|---|---|
| JOB_ID0000001 | COMPLETED | COMPLETED | 01 | 5/18/2009/13:00 | MEDIUM |
| JOB_ID0000002 | PRINTING | UNCOMPLETED | 02<br>03 | 5/18/2009/13:32 | MEDIUM |
| JOB_ID0000003 | STANDBY | UNCOMPLETED | — | 5/18/2009/15:00 | MEDIUM |
| JOB_ID0000004 | STANDBY | UNCOMPLETED | — | 5/18/2009/16:00 | MEDIUM |
| JOB_ID0000005 | STANDBY | UNCOMPLETED | — | 5/18/2009/17:00 | HIGH |
| | | | | | |
| | | | | | |

IMAGE FORMING APPARATUS INCLUDING A PRINTING APPARATUS WITH A PLURALITY OF TRAYS FOR PRINTING ONE GROUP AND OUTPUTTING TO THE PLURALITY OF TRAYS

BACKGROUND OF THE INVENTION

1. Field of the Invention

The present invention relates to an image forming apparatus preferably including an image printing unit and a plurality of paper output trays.

2. Description of the Related Art

When printed materials (printed sheets) of a plurality of jobs are output to a plurality of paper output trays of printing apparatuses, identifying a tray storing a printed material of an intended job is difficult. In particular, when printed materials are output a tray different from an intended one because of restrictions in printing or of the apparatus, such a problem stands out and causes inconvenience regarding usability.

To avoid such a problem, an apparatus disclosed in Japanese Patent Laid-Open No. 9-295748 informs users that a printed material is output to an unintended tray when an intended tray becomes full, thereby indicating the tray storing the output printed material.

However, when an output order is very important for a document, information on the output order is also needed. In particular, when a plurality of copies of a document including a plurality of pages is printed, page information alone is insufficient and an order of collecting the copies of the document from trays is important.

SUMMARY OF THE INVENTION

The present invention is made based on recognition of the foregoing disadvantages. The present invention relates particularly to an operation executed in a printing apparatus including a plurality of trays when printed results of one group, e.g. one job, are output to the plurality of trays.

The present invention provides an image forming apparatus allowing, when printed materials of a group are output to a plurality of storage units, users to easily recognize an order of collecting the printed materials so that the printed materials are arranged in a page order, thereby reducing the users' work.

An image forming apparatus according to an aspect of the present invention is arranged to produce groups of printed sheets. Each group includes a plurality of sequential sheets. The image forming apparatus includes a plurality of storage units each configured to store the printed sheets produced by an image forming unit, a sorter unit configured to sort the printed sheets of a group into a plurality of portions, wherein the sheets in each portion are in sequential order, and to output each of the portions to a different storage unit, and a display unit configured to display an indication of the storage unit storing the portion including the first or the last sheet of the group such that a user is directed to collect the portion including the first or the last sheet of the group from the indicated storage unit first.

Further features of the present invention will become apparent from the following description of exemplary embodiments with reference to the attached drawings.

DESCRIPTION OF THE EMBODIMENTS

Exemplary embodiments of the present invention will be described in detail below with reference to the accompanying drawings. Relative arrangement of elements and a shape of an apparatus described in the exemplary embodiments are illustrative only and the scope of this invention should not be limited to these examples.

Herein, "an image forming apparatus" includes not only a dedicated device having a printing function but also a multifunction peripheral having the printing function and other functions and manufacturing equipment forming images and patterns on a recording sheet. Exemplary embodiments indicate an example in which a printing apparatus performs mass printing using a roll sheet serving as a printing sheet. However, since the scope of the present invention relates to sorting of printed materials to trays and collection of the printed materials from the trays, the scope of the present invention is not limited to the roll sheet serving as the printing sheet.

Figure 1:
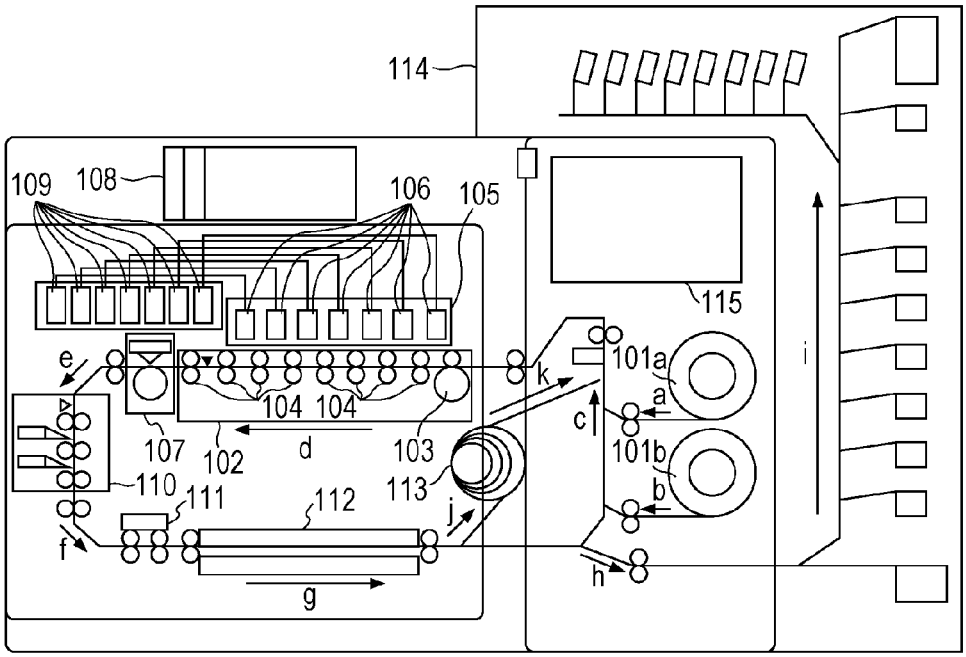
FIG. 1 is a sectional view illustrating a configuration of an image forming apparatus according to an exemplary embodiment of the present invention.

FIG. 1 is a sectional view of a configuration of an image forming apparatus using a roll sheet (i.e., a continuous sheet having a conveying-direction length longer than a unit length of printing). The image forming apparatus includes a roll sheet unit 101, a conveying unit 102, a conveying encoder 103, conveying rollers 104, a head unit 105, printing heads 106, a scanner unit 107, a control unit 108, ink tanks 109, a cutter unit 110, a back-side printing unit 111, a dryer unit 112, a sheet winding unit 113, a sorter unit 114, and an operation unit 115, which are arranged in a housing. The control unit 108 includes a control portion having a controller, user interfaces, and various input/output (I/O) interfaces. The control unit 108 manages various control operations of the image forming apparatus.

The roll sheet unit 101 includes two sheet cassettes, i.e., an upper sheet cassette 101*a* and a lower sheet cassette 101*b*. A user equips each of the sheet cassettes 101*a* and 101*b* with a roll printing sheet (hereinafter, simply referred to as a sheet) and then inserts the sheet cassette 101*a* or 101*b* into the image forming apparatus from the front. The sheet from the upper sheet cassette 101*a* is conveyed in a direction "a" illustrated in FIG. 1, whereas the sheet from the lower sheet cassette 101*b* is conveyed in a direction "b" illustrated in FIG. 1. The long continuous sheet from the selected one of the sheet cassettes 101*a* and 101*b* is conveyed in a common conveying path in a direction "c" illustrated in FIG. 1 to reach the conveying unit 102. The conveying unit 102 includes the plurality of pairs of conveying rollers 104. During printing, the pairs of conveying rollers 104 convey the sheet in a direction "d" (i.e., the horizontal direction) illustrated in FIG. 1.

The head unit 105 is located above the sheet conveyed by the conveying unit 102 to face a printing surface of the sheet. In the head unit 105, the plurality of printing heads 106 eject ink to record an image on the sheet. In the exemplary embodiment, seven printing heads 106 for seven colors, i.e., cyan (C), magenta (M), yellow (Y), light cyan (LC), light magenta (LM), gray (G), and black (K) are held along the sheet conveying direction. In synchronization with conveying of the sheet by the conveying unit 102, the printing heads 106 eject ink to form an image on the sheet. The conveying unit 102, the head unit 105, and the printing heads 106 constitute a printing apparatus unit. The ink tanks 109 independently store ink of each color. The ink of each color is supplied from the corresponding ink tank 109 to a sub tank provided for the corresponding color through a tube. The ink is then supplied from the sub tank to the corresponding printing head 106 through a tube. Each of the printing heads 106 is a line head of the respective color. The printing head 106 may be formed of a single joint-free nozzle chip or separated nozzle chips regularly arranged in a row or zigzag. Each of the printing heads 106 is a so-called full multi head having nozzles arranged to cover a width of a largest sheet to be used. As an ink-jet method for ejecting ink from a nozzle, one using a heater element, one using a piezoelectric element, one using an electrostatic element, and one using a microelectromechanical systems (MEMS) element can be adopted. Ink is ejected from the nozzle of each head based on print data in accordance with an output signal of the conveying encoder 103. The present invention is not limited to ink-jet printers and can be applied to printers of various printing methods, such as thermal printers (including a dye sublimation type and a thermal transfer type), dot impact printers, light emitting diode (LED) printers, and laser printers.

The sheet having the formed image is then conveyed from the conveying unit 102 to the scanner unit 107. The scanner unit 107 scans the image or a special test pattern printed on the sheet to determine whether the printed image is defect-free and to check a status of the image forming apparatus. In this exemplary embodiment, the scanner unit 107 is used for creating correction data of the image. The image correction data can be created by printing a pattern for checking a state of the heads with the printing apparatus unit, scanning the pattern with the scanner unit 107, and analyzing the scanned data. Alternatively, the image correction data may be created by scanning the printed image with the scanner unit 107 based on image information, comparing the scanned data with the original image data, and analyzing the comparison result.

The sheet is conveyed from the scanner unit 107 in a direction "e" to reach the cutter unit 110. The cutter unit 110 cuts the sheet into a predetermined unit length of printing. The predetermined unit length of printing differs depending on the size of the image to be printed. For example, an L-size photo has a conveying-direction length of 135 mm, whereas an A4-size sheet has a conveying-direction length of 297 mm.

The sheet is then conveyed in the cutter unit 110 in an illustrated direction "f" to reach the back-side printing unit 111 from the cutter unit 110. The back-side printing unit 111 is for printing, on a back side of the sheet, information regarding each image printed on a front side (e.g., an order management number).

The sheet passing through the back-side printing unit 111 is conveyed to the dryer unit 112. The dryer unit 112 heats the sheet with warm air while conveying the sheet in the dryer unit 112 in an illustrated direction "g" to dry the ink on the sheet in a short time. Each page of the sheet passes through the dryer unit 112 and is conveyed in an illustrated direction "h" to reach the sorter unit 114.

The sorter unit 114 stacks the sheets passing therethrough in an illustrated direction "i" on corresponding trays having numbers set for each printed image while checking the sheet with sensors. The sorter unit 114 includes a plurality of trays (22 trays in this exemplary embodiment) serving as a plurality of storage units. The sorter unit 114 selects a tray for stacking the sheet in accordance with the unit length of printing. The sorter unit 114 also displays a status, such as now stacking and stacking completed (e.g., using LEDs). The sorter unit 114 will be described in detail later.

A procedure of duplex printing on a sheet will now be described. The printing apparatus unit prints images on a first side of a sheet from the sheet cassette 101*a* or 101*b*. The sheet having the printed images is then conveyed to the scanner unit 107, the cutter unit 110, and the dryer unit 112. At this time, the cutter unit 110 does not cut the sheet for each image.

The printing apparatus unit continuously forms, on the first side of the sheet, a group of images to be printed on the first side belonging to a job including a plurality of images and a job group including a plurality of jobs. The cutter unit 110 cuts the sheet at a point where the group of images printed on the first side of the sheet ends.

A leading end of the sheet having passed the dryer unit 112 is guided to the sheet winding unit 113. The sheet winding unit 113 includes a winding rotational body (e.g., a drum) for winding the sheet and a clamp for temporarily fixing the leading end of the sheet onto the winding rotational body. Once the clamp fixes the leading end of the sheet onto the winding rotational body, the winding rotational body rotates counterclockwise in FIG. 1 to wind the sheet. Depending on the number of images to be printed, the printing apparatus unit keeps printing the images on an upstream side of the sheet during winding. After the sheet winding unit 113 finishes winding the sheet to reach the end of the sheet cut by the cutter unit 110, a trailing end of the wound sheet is then conveyed in a direction "k" from the sheet winding unit 113. That is, the trailing end of the sheet cut by the cutter unit 110 is now conveyed to the printing apparatus unit as a leading end.

The printing heads 106 oppose to a second side, i.e., a side opposite to the first side having the recorded images, of the sheet conveyed to the printing apparatus unit. The printing heads 106 sequentially and continuously print, on the second side of the sheet, images to be printed on the back side of the images printed on the first side.

The sheet is then conveyed to the scanner unit 107 and the cutter unit 110 from the printing apparatus unit. The cutter unit 110 cuts the sheet for each image. The cutter unit 110 then sends each printed material (sheet) having undergone duplex printing to a downstream side. The cut pieces (sheets) of the roll sheet are conveyed to the sorter unit 114 through the dryer unit 112.

The operation unit 115 includes a display portion allowing users to check a printing status of each order, such as a tray storing images of a specified order and whether printing is underway or finished, and a status of the apparatus, such as an amount of remaining ink and an amount of remaining sheet. The operation unit 115 also includes an operation portion operated by operators to instruct execution of apparatus maintenance, such as head cleaning. The operation portion includes keys to be operated. The display portion includes a liquid crystal display displaying the apparatus status and LEDs indicating errors of the apparatus.

Figure 2:
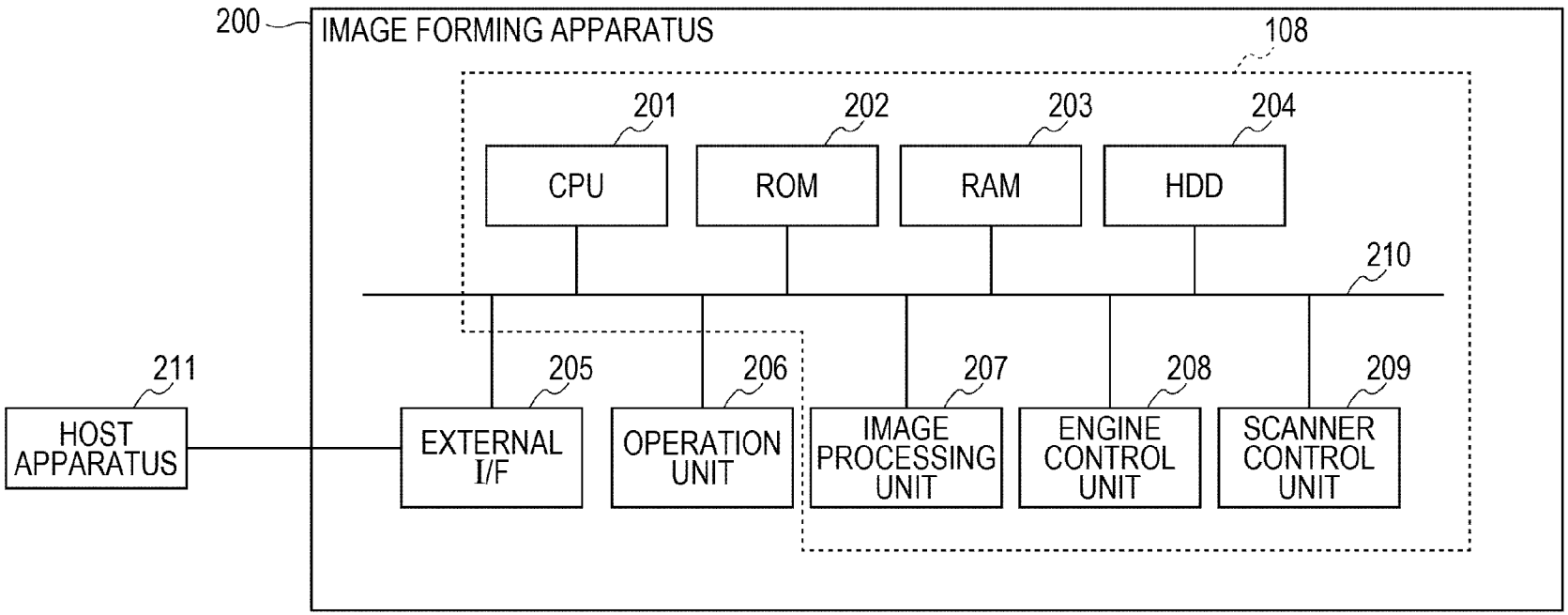
FIG. 2 is a block diagram for describing a control configuration of the image forming apparatus.

FIG. 2 is a block diagram for describing a control configuration of an image forming apparatus 200 employed in this exemplary embodiment. The image forming apparatus 200 includes the control unit 108. The control unit 108 includes a central processing unit (CPU) 201, such as a microcomputer, and a read-only memory (ROM) 202 storing programs, tables, and other fixed data. The control unit 108 also includes a random access memory (RAM) 203 having areas for control commands received from a host apparatus 211 and an work area and a hard disk drive (HDD) 204 temporarily storing image data supplied from the host apparatus 211 and the tables.

The control unit 108 includes an operation unit 206 which is a block for controlling the operation unit 115. The operation unit 206 controls the display portion for displaying the apparatus status, the keys, and the LEDs and allows operators to input operation instructions, register various pieces of data, and check the apparatus status.

The control unit 108 includes an image processing unit 207 which manages image processing in the image forming apparatus 200. More specifically, the image processing unit 207 converts a color space (e.g., YCbCr) of image data into a standard RGB color space (e.g., sRGB). The image processing unit 207 also executes various kinds of image processing, such as resolution conversion into the number of effective pixels, image analysis, and image correction. Print data resulting from the image processing is stored in the RAM 203 or the HDD 204.

The control unit 108 includes an engine control unit 208 which controls printing of the print data on a recording medium in accordance with received control commands. More specifically, the engine control unit 208 instructs the printing head of each color to eject ink, sets ejection timing to adjust a position of a dot on the recording medium, and acquires a head driving state. That is, the engine control unit 208 controls driving of the printing heads in accordance with the print data to cause the printing heads to eject ink and form an image on the recording medium. The engine control unit 208 also controls the conveying rollers, such as instructing driving of feeding rollers, instructing driving of the conveying rollers, and acquiring a rotation state of the conveying rollers, so that the recording medium is conveyed at an appropriate speed and stopped. The engine control unit 208 also controls the sorter unit 114. More specifically, the engine control unit 208 controls a paper-absence sensor of each tray of the sorter unit 114, a solenoid for switching paper output trays, and LEDs of each tray.

The control unit 108 includes a scanner control unit 209. The scanner control unit 209 controls image sensors, such as a charge coupled device (CCD) and a contact image sensor (CIS), in accordance with received control commands to scan an image on the recording medium and acquire analog luminance data of red (R), green (G), and blue (B). More specifically, the scanner control unit 209 instructs driving of the image sensors, acquires statuses of the image sensors, analyzes the luminance data acquired from the image sensors, and detects an ink ejection failure and a cut position of the recording medium.

The host apparatus 211 is externally connected to the image forming apparatus 200 and supplies images to the image forming apparatus 200. The host apparatus 211 may be a computer creating and processing data of images to be printed or a scanner for scanning images. The image forming apparatus 200 can receive image data and other commands supplied from the host apparatus 211 and send status signals to the host apparatus 211 through an external interface (I/F) 205. The blocks included in the image forming apparatus 200 are connected with each other through a system bus 210. The control configuration is not limited to the one described in this exemplary embodiment. Each of the processing units and the control units may be divided into a plurality of portions and each of the divided portions may include a CPU to execute control operations. However, the control method is not limited to these examples.

Figure 3:
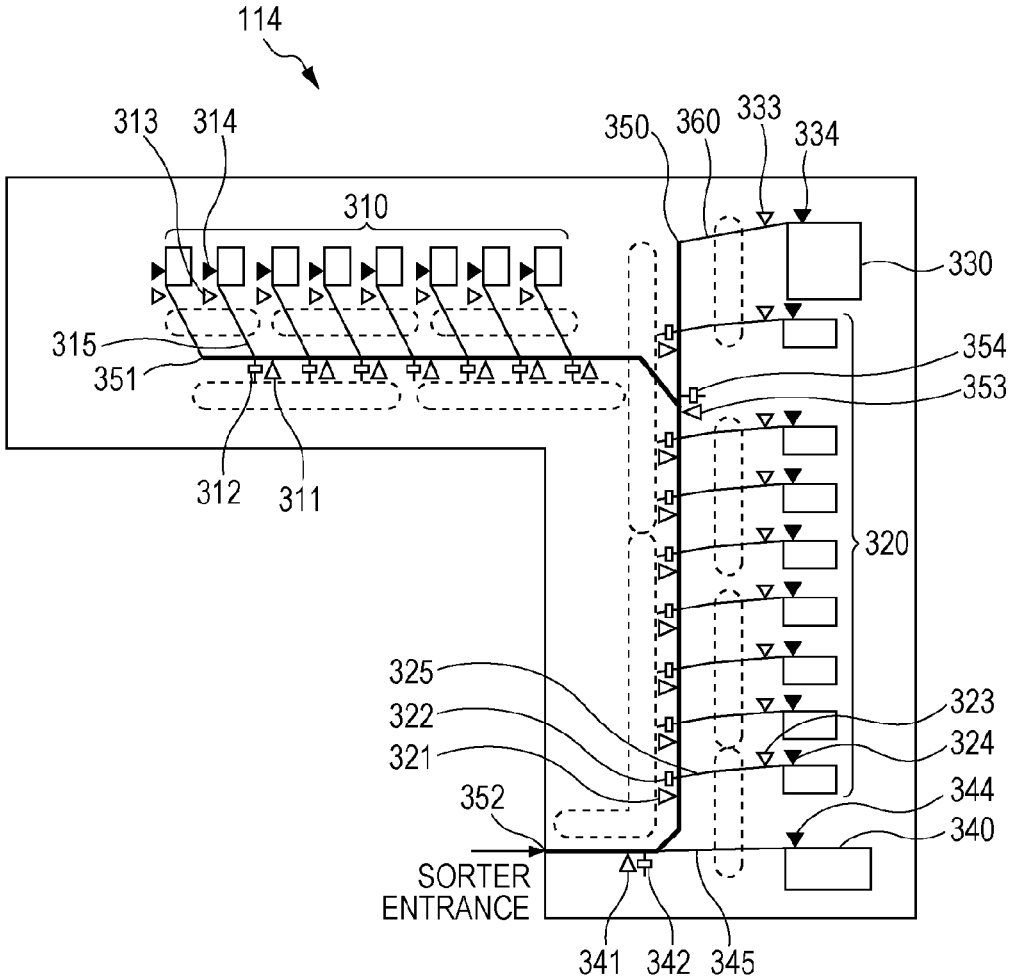
FIG. 3 is a diagram schematically illustrating a sorter unit.

FIG. 3 is a diagram schematically illustrating a configuration of the sorter unit 114. A printed material having been printed, cut, and dried enters the sorter unit 114 from a bottom part thereof and is stacked on a tray serving as a sorting-destination storage unit specified by the image forming apparatus 200. The sorter unit 114 has a plurality of kinds of trays, such as trays intended for storing different-sized printed materials and trays for storing printed materials for a specific purpose.

Small trays 310 are used for outputting small printed materials. Large trays 320 are generally used for outputting large printed materials but can be used for outputting the small printed materials. The sorter unit 114 includes more than one small tray 310 and more than one large tray 320. A temporary tray 330 is larger than the large trays 320. The temporary tray 330 can store printed materials that do not fit into the large trays 320. The temporary tray 330 can also serve as a temporary output destination when other trays are unavailable. Printed materials other than products of printing, such as ones having special patterns that are no longer needed after being scanned by the scanner unit 107, are output to a tray 340 (so products of printing not required by a user are output to tray 340).

A conveying path of printed materials is generally categorized into two kinds (hereinafter, referred to as "a main path" and "a sub path"). A printed material enters the sorter unit 114 from a sorter entrance 352 and goes along main paths 350 and 351. Sub paths branch off from the main paths 350 and 351 to guide the printed material to each tray. The sub path is provided for each tray.

A printed material having entered the sorter unit 114 travels along the main paths 350 and 351. The conveying path is switched by a conveying path switch in front of a sorting-destination tray and the printed material enters the sub path. When one of the large trays 320 is selected as the sorting destination of the printed material, a conveying path switch 322 switches the path of the printed material from the main path 350 to a sub path 325 of the selected large tray 320. The printed material is output to the selected large tray 320 through the sub path 325. When one of the small trays 310 is selected, a conveying path switch 354 switches the path of the printed material from the main path 350 to the main path 351. A conveying path switch 312 then switches the path from the main path 351 to a sub path 315 of the selected small tray 310.

The printed material is output to the selected small tray 310 through the sub path 315. When the printed material is output to the temporary tray 330, switching of the path to the sub path is not executed by the conveying path switches provided in the main path 350. The printed material enters to the sub path of the temporary tray 330 from an end of the main path 350. When the tray 340 is selected, a conveying path switch 342 switches the path to a sub path 345 of the tray 340. In such a manner, sheets or printed materials guided to the sub paths are stacked on the trays 310, 320, 330, and 340.

A sensor 341 for detecting presence or absence of a sheet is arranged on an upstream side of the conveying path switch 342 of the main path 350. A sensor 321 for detecting presence or absence of a sheet is arranged on an upstream side of each conveying path switch 322 for the large tray 320 in the main path 350. A sensor 311 for detecting presence or absence of a sheet is arranged on an upstream side of each conveying path switch 312 for the small tray 310 in the main path 351. Sensors 313, 323, and 333 for detecting presence or absence of a sheet are also arranged in the respective sub paths. These sensors are used to detect a paper jam. In addition to detecting the paper jam, the sensors arranged on the upstream side of the corresponding conveying path switches are used by the conveying path switches to determine switching timing.

Paper-presence detecting sensors 314, 324, 334, and 344 arranged on the corresponding trays are used to detect whether operators have removed the printed material stacked on the trays.

Dotted lines parallel to the main paths or grouping the plurality of sub paths indicate independent units for driving a conveyer in the conveying path. Accordingly, stopping and driving the conveyer are executed in conjunction with each other in a range of the conveying path. For example, when a paper jam occurs in the sub path to the temporary tray 330, the conveyer to the large tray immediately under the sub path to the temporary tray 330 also stops in response to stopping of the conveyer in the sub path. Alternatively, even if a point in the main path having a paper jam is stopped, the main conveying path belonging to a different driving unit does not have to be stopped.

Figure 4:
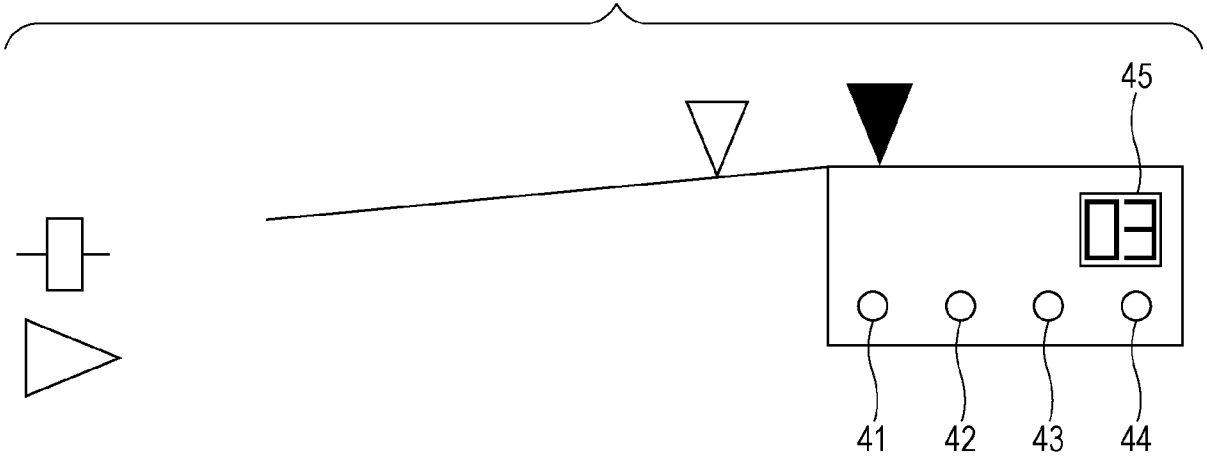
FIG. 4 is a diagram schematically illustrating a display configuration of each tray of the sorter unit.

FIG. 4 is a diagram schematically illustrating a configuration of LEDs installed in each tray illustrated in FIG. 3.

Figure 15:
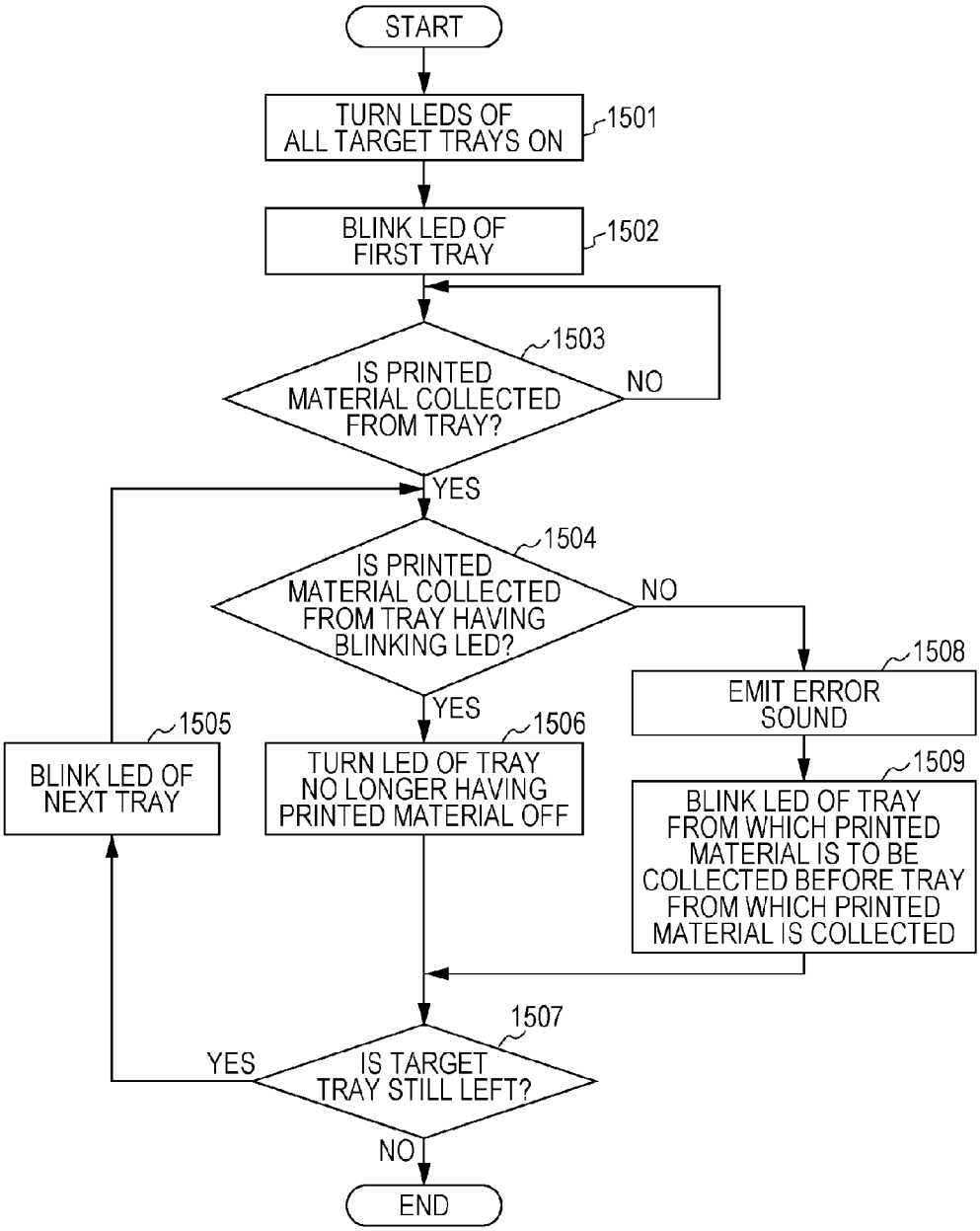
FIG. 15 is a flowchart illustrating an operation of an LED of each tray of the sorter unit when a user collects a printed material from the tray.

Each of the small trays 310, the large trays 320, and the temporary tray 330 illustrated in FIG. 3 includes LEDs for displaying a state of the tray. A discharge LED 41 is turned on or blinked while a sheet is being output to the tray. The image forming apparatus employed in this exemplary embodiment can execute interrupt printing by printing images of a second group input as interruption first after temporarily stopping printing of images of a first group currently underway. An interrupt LED 42 indicates a tray storing a printed material resulting from the interrupt printing. When pages of a printed material are output to a plurality of trays because the number of pages exceeds an allowable value of each tray or circumstances to be described later occur, the printed material is to be output to the tray after some time even if the tray is now vacant. When such a state is detected in advance, a reserve LED 43 indicates such a state. A job LED 44 indicates a job. More specifically, the job LED 44 indicates a tray to which a job specified through the operation unit 115 is output. The job LED 44 also indicates an order of collecting the printed materials from the trays. Operations of the LEDs are illustrated in FIG. 15 in detail. A display unit 45 displays a status of the tray. In accordance with this exemplary embodiment, the display unit 45 can display a two-digit figure. However, the display unit 45 is not limited to the example described in this exemplary embodiment as long as the display unit 45 can display a figure.

Figure 5:
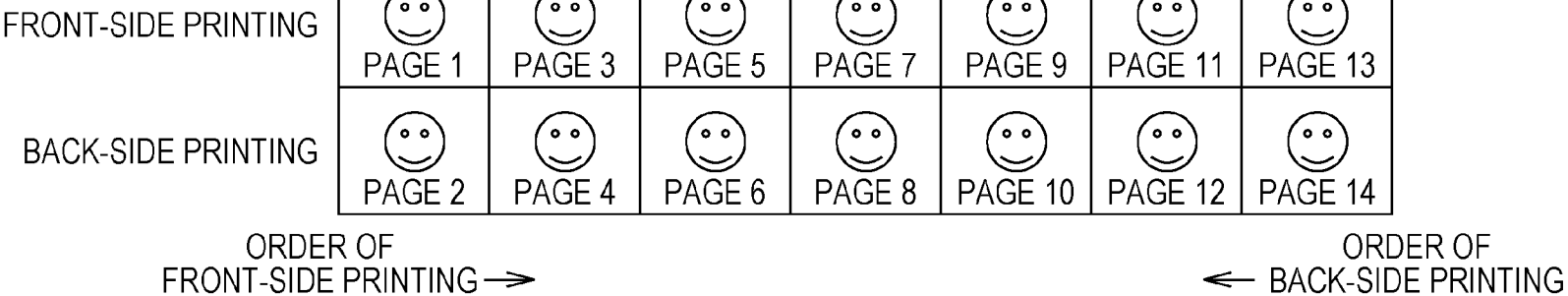
FIG. 5 is a diagram illustrating an order of printing pages on a continuous sheet in duplex printing.

FIG. 5 is a diagram illustrating an order of pages printed on a roll sheet in duplex printing.

In a duplex printing method, printing is executed on a first side (e.g., a front side) of a sheet. The image processing unit 207 creates data of images to be printed on the both sides of the sheet. After the creation of the image data to be printed on the front side, the image processing unit 207 sends the image data to the engine control unit 208 and instructs the engine control unit 208 to start printing the images on the front side. Upon receiving the instruction, the engine control unit 208 feeds the sheet from the roll sheet unit 101 and causes the conveying unit 102 to convey the sheet to the head unit 105. The head unit 105 prints the instructed images on the front side of the conveyed sheet. As illustrated in FIG. 5, the images of odd pages are continuously printed on the front side of the sheet from the first page. After passing through the head unit 105, the sheet is conveyed to the scanner unit 107. After the scanner unit 107 checks the images, the sheet is then conveyed to the cutter unit 110. In the front-side printing, the cutter unit 110 does not cut the sheet into a unit length of printing. The continuous sheet is dried in the dryer unit 112 and wound by the sheet winding unit 113.

The foregoing operation is executed until printing of all of the instructed images on the front side ends. After the front-side printing ends, the image processing unit 207 sends the image data to be printed on a second side (e.g., a back side) to the engine control unit 208 and instructs the engine control unit 208 to start printing the images on the back side. The engine control unit 208 pulls out the sheet having the images printed on the front side from the sheet winding unit 113 and conveys the sheet back to the conveying unit 102.

The conveying unit 102 conveys the sheet having undergone the front-side printing to the head unit 105. In the second-side printing, the head unit 105 continuously prints images of even pages from the last even page as illustrated in FIG. 5. More specifically, the image of page 14 is formed on the back side of the image of page 13 printed on the front side and even-page printing is executed to reach page 2. Part of the sheet bearing the formed image is conveyed to the scanner unit 107. After the scanner unit 107 checks the image, the sheet is conveyed to the cutter unit 110. The cutter unit 110 cuts the sheet having undergone the back-side printing into the unit length of printing. The cut printed material is dried by the dryer unit 112 and then conveyed to the sorter unit 114. The sorter unit 114 conveys the printed material to a tray specified before printing. The engine control unit 208 may change the specified tray depending on current statuses of the engine and the trays. In duplex printing, the images are arranged in accordance with an order of the print instructions. On the front side, odd pages of the print-instructed data are sequentially printed. On the back side, even pages are arranged and printed. Accordingly, the pages are printed on the back side in a page descending order although the pages are printed on the front side in a page ascending order.

Figure 6:
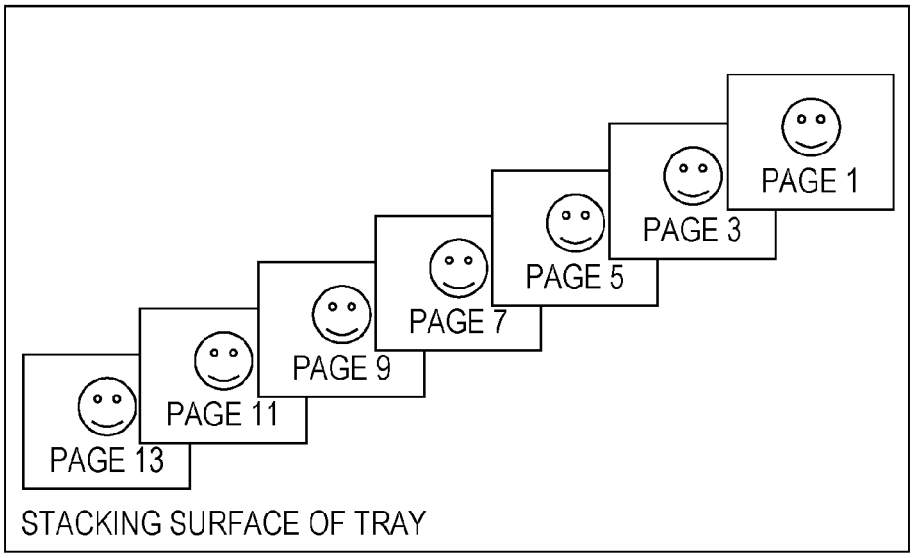
FIG. 6 is a diagram illustrating an order of pages stacked on a tray in duplex printing using a continuous sheet.

FIG. 6 is a diagram illustrating an order of stacking printed materials resulting from the duplex printing on a tray. In the duplex printing, the images are printed on the back side in the page descending order after the images are printed on the front side in the page ascending order. Since the sorter unit 114 conveys the printed images to a tray, the printed images are stacked on the tray in the page descending order. The back side of the sheet faces down when the sheet is conveyed to the dryer unit 112 after the back-side printing. Accordingly, when the sheet is stacked on the tray, the images printed on the front side, i.e., sides of the odd-pages, face up. Thus, as illustrated in FIG. 6, the printed materials are stacked on the tray in accordance with the page number from the top.

Figure 7:
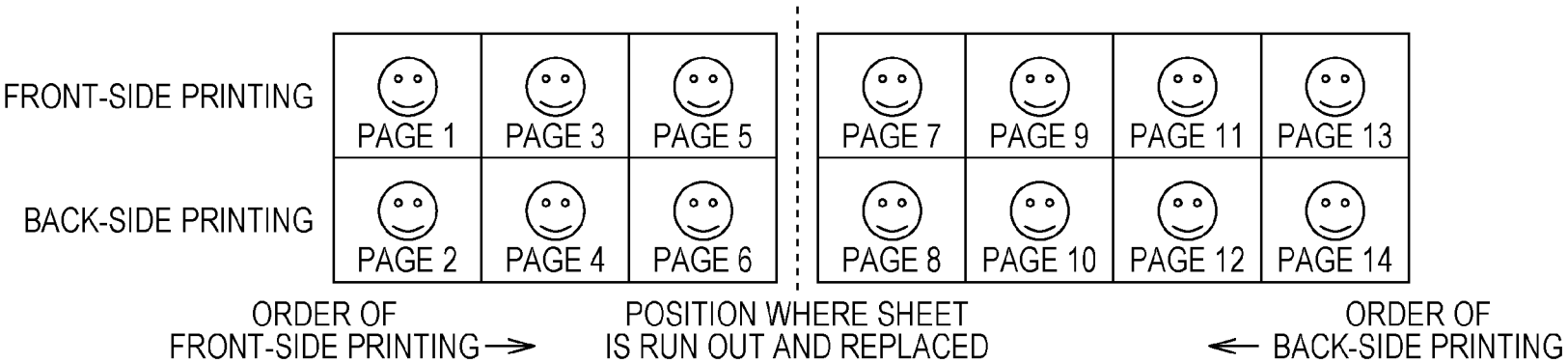
FIG. 7 is a diagram illustrating an order of printing pages when interrupt printing or a paper-out state occurs during duplex printing.

FIG. 7 is a diagram illustrating a print state when interrupt printing or a paper-out state occurs while front-side printing is being executed on a roll sheet in duplex printing. When the paper-out state occurs during the front-side printing of the duplex printing (in FIG. 7, the paper-out state occurs during printing of the third image on the front side), the sheet winding unit 113 winds the sheet after three images are printed on the front side. Thereafter, the image processing unit 207 sends image data of images to be printed on the back side to the engine control unit 208 and instructs the engine control unit 208 to start printing the images on the back side. The image data of as many images as those printed on the front side is sent at this time. The images are printed on the back side of the images printed on the front side. The head unit 105 forms the images on the back side. The sheet passes through the scanner unit 107 and is then cut by the cutter unit 110 into pages. The printed materials having passed the dryer unit 112 are stacked by the sorter unit 114 on the specified tray.

After finishing the interrupt printing or replacement of the roll sheet, the image processing unit 207 sends data of the rest of images to be printed on the front side, excluding the data of the images having been printed on the front side, to the engine control unit 208 and instructs the engine control unit 208 to start printing the images on the front side. In the example illustrated in FIG. 7, images of odd pages are sequentially formed on the front side of the sheet from page 7. After finishing the front-side printing, the image processing unit 207 sends data of images to be printed on the back side corresponding to the images printed on the front side to the engine control unit 208 and instructs the engine control unit 208 to start printing the images on the back side. In the example illustrated in FIG. 7, the image of page 14 is printed on the back side of the image of page 13 printed on the front side and then the images of even pages are formed in the page descending order. After finishing the back-side printing, the sorter unit 114 conveys the printed materials to the tray. The similar operation is executed when interrupt printing occurs during printing of the third image on the front side.

Figure 8:
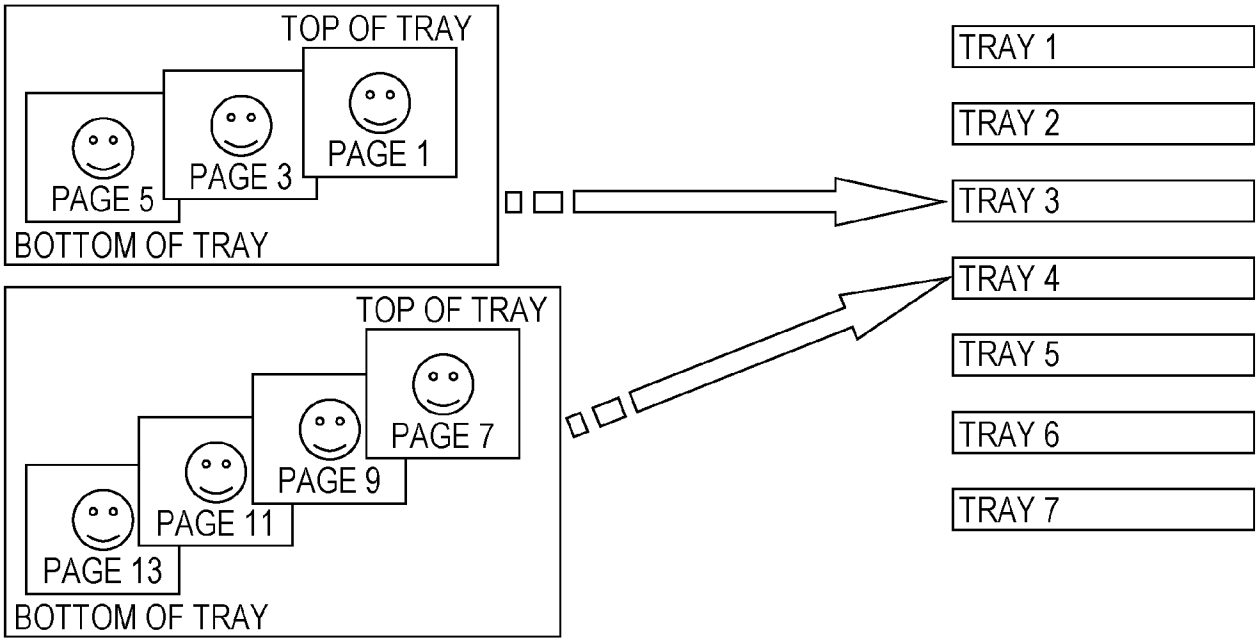
FIG. 8 is a diagram illustrating a method for stacking printed images on different trays in the same order when a paper-out state occurs during duplex printing.

FIG. 8 illustrates a procedure for stacking printed materials resulting from such two discontinuous recording operations on trays. When interrupt printing occurs during front-side printing of duplex printing or a printing operation is suspended because of a paper-out state, printed materials yielded before and after the suspension are sorted into different trays as illustrated in FIG. 8.

Since printed materials are stacked on a tray in the page descending order, pages of the printed materials are out of order even if the printed materials are stacked on the same tray in the same sorting order. Accordingly, the printed materials yielded before the suspension and those after the suspension are output to different trays that are as close as possible. For example, when trays 3 and 4 are available, the printed materials yielded before the suspension are stacked on the tray 3, whereas the rest of the printed materials yielded after the suspension are stacked on the tray 4. In this way, by simply collecting and piling the images stacked on the trays 3 and 4, operators can arrange the printed materials in a page order. The use of two different trays eliminates a user's work for rearranging the pages later. When only one tray is available, the image forming apparatus can inform the user that images are arranged in the same sorting order but the pages are out of order by inserting another sheet (e.g., a color sheet) between the images printed before the paper-out state and those printed on a new sheet after the paper-out state. In this way, since the users can know (easily recognize) the first image printed on the new sheet, the users can rearrange the pages more easily.

Figure 9:
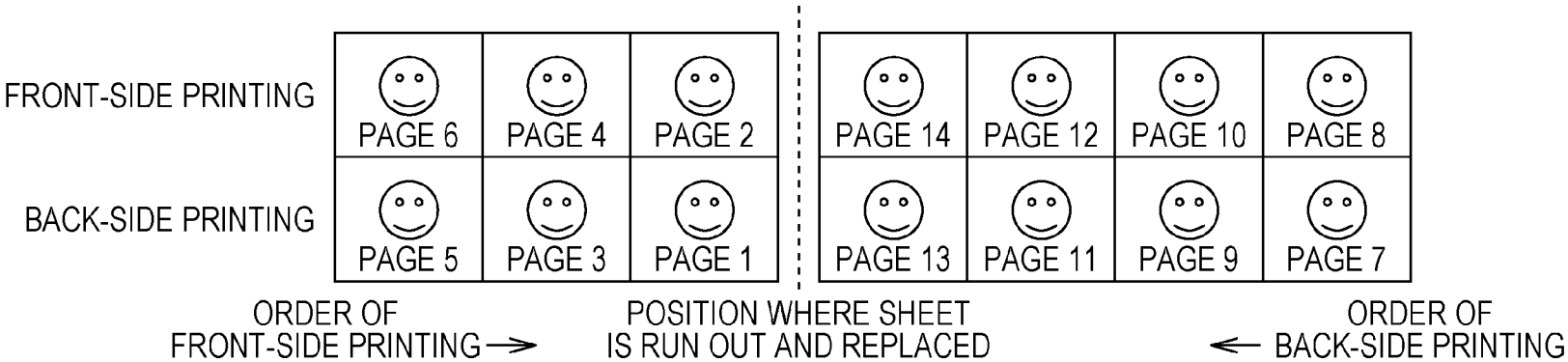
FIG. 9 is a diagram illustrating an order of printed pages when occurrence of a paper-out state is detected before execution of duplex printing.

FIG. 9 is a diagram illustrating an order of printing pages when it is detected that an amount of remaining sheet is insufficient for printing all images of a job. Accurately grasping (obtaining) an amount of remaining roll sheet is difficult because of a structure thereof. However, by managing an amount of conveyed printed materials and other conveyed materials in association with the sheet using the conveying encoder 103 and calculating the amount of remaining sheet, the image forming apparatus can grasp (obtain) the amount of remaining sheet. If the image forming apparatus can determine in advance that the paper-out state will occur during printing of images of a job, images printed before the paper-out state and images printed on the new sheet can be stacked on the same tray by setting the order of printing the pages as illustrated in FIG. 9. In this way, users' burden can be reduced.

Referring to FIG. 9, even pages that can be printed before the paper-out state are printed on the front side from the last one (so starting with the last one), whereas odd pages are printed on the back side from the first one (so starting with the first one). The bottommost printed material is output so that page 1 faces down. After installation of a new sheet, even pages are printed on the front side from the last one, whereas odd pages are printed on the back side from the first one. Printed materials are sequentially output so that the page continued from the last page of the printed material yielded before the paper-out state faces down.

Figure 10:
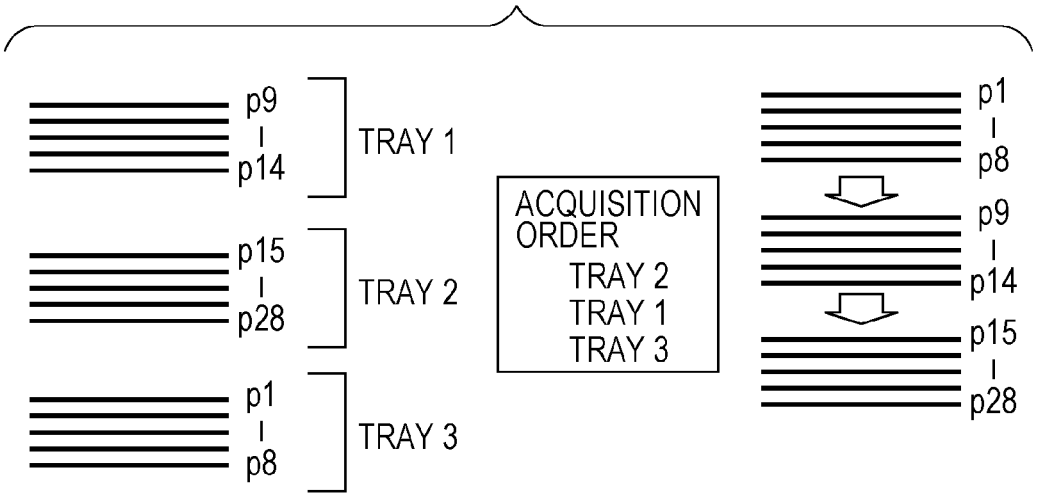
FIG. 10 is a diagram illustrating an overview of a state of printed materials output to trays.

A description will be now given for displaying of an order of collecting printed materials when printing is suspended because interrupt printing or a paper-out state occurs and a group of printed materials are output to a plurality of trays. FIG. 10 illustrates an example in which a 28-page printed material resulting from duplex printing is separately stacked on trays 1 to 3. More specifically, the printed material is divided into three portions including pages 1-8, pages 9-14, and pages 15-28 and the three portions are output to the respective trays. Images are printed on both sides of each page.

On the tray 1, the duplex-printed materials of Pages 9-14 are stacked in a page order. An upper side of the topmost printed material is page 9, whereas a lower side thereof is page 10. An upper side of the bottommost printed material is page 13, whereas a lower side thereof is page 14. The printed materials are also stacked on the trays 2 and 3 in the page order from the top. In this case, to arrange the printed materials in the page order, a user collects bundles of the printed materials sequentially from the tray 2, the tray 1, and the tray 3. The user then piles the bundle of the printed materials of the tray 1 over the bundle of the printed materials of the tray 2 and further piles the bundle of the printed materials of the tray 3 over the bundle of the printed materials of the tray 1 while maintaining the top and bottom of each bundle of the printed materials. In this way, the user can arrange the printed materials in a proper order. Alternatively, the user may collect bundles of the printed materials sequentially from tray 3, tray 1 and tray 2. The user can place the bundle from tray 3 with page 1 facing downward and page 8 facing upward. The user can then pile the bundle from tray 1, with page 9 facing downward, onto the bundle from tray 3. The user can then pile the bundle from tray 2, with page 15 facing downward, onto the bundle from tray 1. The user can then turn the bundle over so that page 1 is facing upwards. The acquisition order from the trays would thus be tray 3, tray 1 and tray 2. Again, in this way, the user can arrange the printed materials in a proper order. When the printed materials do not have page numbers, the image forming apparatus displays the order of collecting the printed materials from the trays. The user can easily arrange the printed materials in the proper order by acting as indicated.

Figure 11:
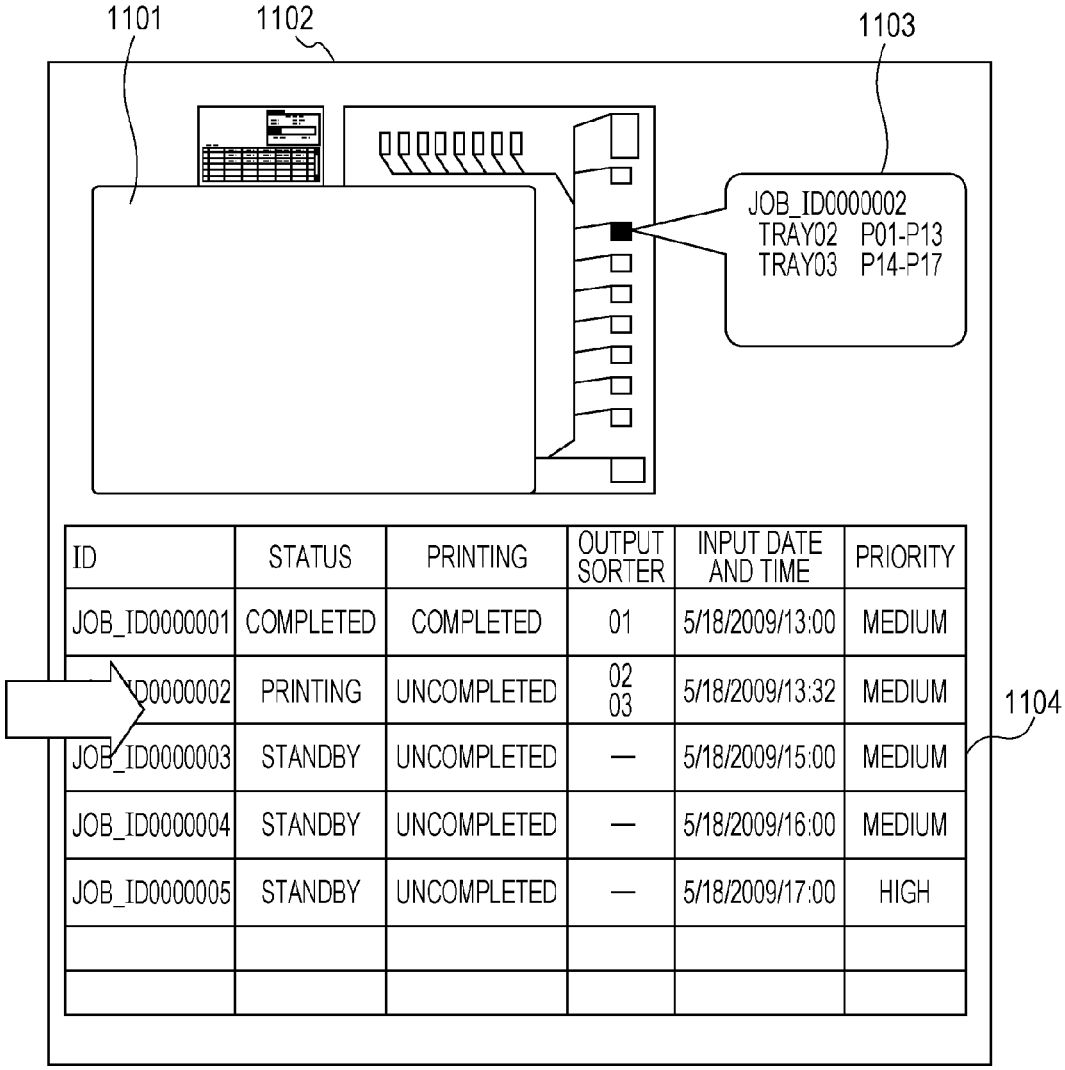
FIG. 11 is a schematic diagram illustrating a print job display method and an operation method thereof.

FIG. 11 illustrates a displayed content of a liquid crystal screen serving as the display portion of the operation unit 115. Since the liquid crystal screen has a touch panel, a user can perform an operation by touching the screen.

A main body display portion 1101 displays an external appearance of a main body and a state of the sorter unit 114, thereby being able to display the states.

A job list display portion 1102 displays a list of print jobs executed by the image forming apparatus. More specifically, the job list display portion 1102 displays information regarding a job, such as a job ID, a state of the job, and completion/incompletion of printing. A sorter detail display portion 1103 indicates a state of the sorter unit 114 for a current job. A job display portion 1104 displays a job selected in the job list display portion 1102. A selection operation will now be described. Since the display portion has a touch panel as illustrated in the drawing, a user specifies a job, from the displayed job list, with their finger. In the case that printed materials of the specified job have been output (whether the specified job has been fully or partially completed), the sorter detail display portion 1103 displays trays storing the output printed materials of the job. In this case, the sorter detail display portion 1103 indicates that printed materials of a specified job JOB_ID0000002 are output to trays 02 and 03. The sorter detail display portion 1103 also indicates that pages 1-13 and pages 14-17 are output to the trays 02 and 03, respectively.

Figure 12:
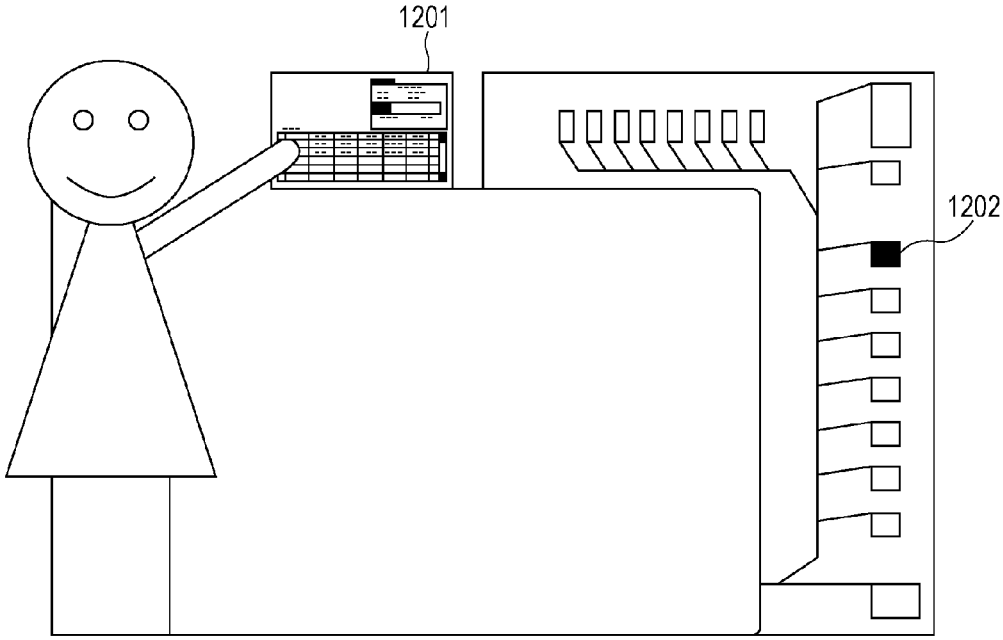
FIG. 12 is a schematic diagram illustrating a print job display method and an operation method thereof.

FIG. 12 illustrates an operation of the LEDs of a tray when a user specifies a job through the operation unit 115 illustrated in FIG. 11.

A screen 1201 in FIG. 12 corresponds to the screen in FIG. 11 displayed on the display portion of the operation unit 115. When the user touches the display portion of the operation unit 115 in this state to specify a job displayed on the screen, an LED of a tray for the job specified by the user is turned on (i.e., a black tray 1202). In accordance with FIG. 11, since the tray 02 and 03 are target trays, the job LED 44 of each of the trays 02 and 03 is turned on in this exemplary embodiment. Furthermore, the job LED 44 of the tray 02 from which the printed materials are collected first is blinked. In accordance with the turned on and blinked job LEDs 44 of the trays 02 and 03, the user knows to sequentially collect the printed materials from the trays. Since the job LED 44 of the tray 02 blinks first, the user collects the printed materials from the tray 02. In response to the collection, the job LED 44 of the tray 02 is turned off and the job LED 44 of the tray 03 blinks. According to the blinking job LED 44, the user collects the printed materials. The group of printed materials is arranged in the page order by piling the printed materials according to the collection order.

Figure 13:
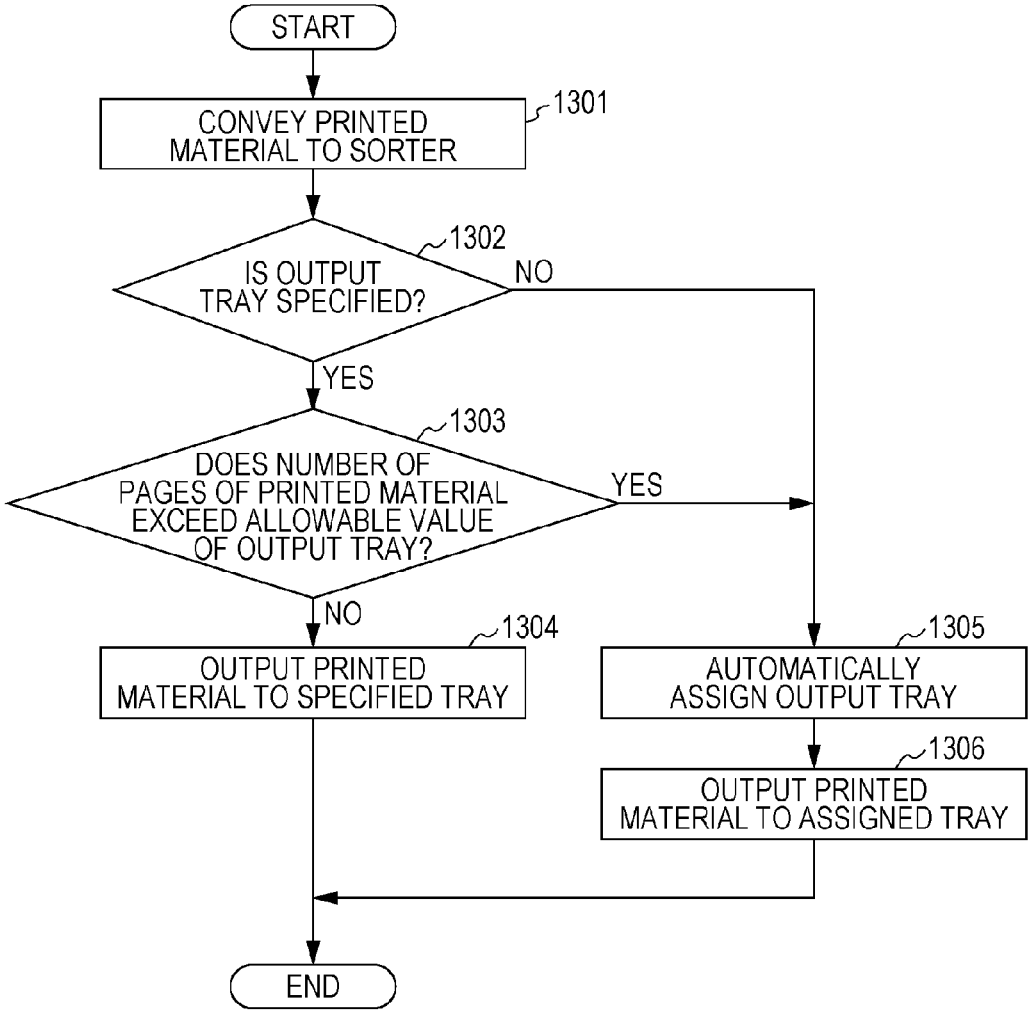
FIG. 13 is a flowchart illustrating a sorting procedure of a sorter unit according to an exemplary embodiment of the present invention.

FIG. 13 is a flowchart illustrating a procedure for sorting printed materials of each group to different trays in the sorter unit 114. Printed materials belonging to a group indicates a plurality of printed materials resulting from one print job, for example. A group may consist of one document.

In STEP 1301, a printed material is conveyed to the sorter unit 114. In STEP 1302, the control unit 108 determines whether an output tray is specified for the conveyed printed material. More specifically, the control unit 108 determines whether the output tray of the printed material is specified by the host apparatus 211 or the image forming apparatus 200 here. If the output tray is specified, the process proceeds to STEP 1303. If the output tray is not specified, the process proceeds to STEP 1305. In STEP 1303, the control unit 108 determines whether a number of pages in the printed material to be output exceeds an allowable value of the tray specified in STEP 1302. If the number of pages exceeds the allowable value, the process proceeds to STEP 1305. If the number of pages does not exceed the allowable value, the process proceeds to STEP 1304. In STEP 1304, the sorter unit 114 outputs the printed material to the specified tray.

In STEP 1305, the sorter unit 114 automatically assigns a tray to which the printed material is output. In this exemplary embodiment, the sorter unit 114 assigns a vacant tray or a tray storing a printed material of the same job as that of the printed material to be output currently. For example, in FIG. 10, when the pages 13 and 14 are output to the tray 1, the tray 1 is assigned for pages 11 and 12 of the printed material to be output next. In STEP 1306, the sorter unit 114 outputs the printed material to the tray assigned in STEP 1305.

The method illustrated in the flowchart of FIG. 13 allows the sorter unit 114 to rapidly sort and output the printed materials to the tray.

Figure 14:
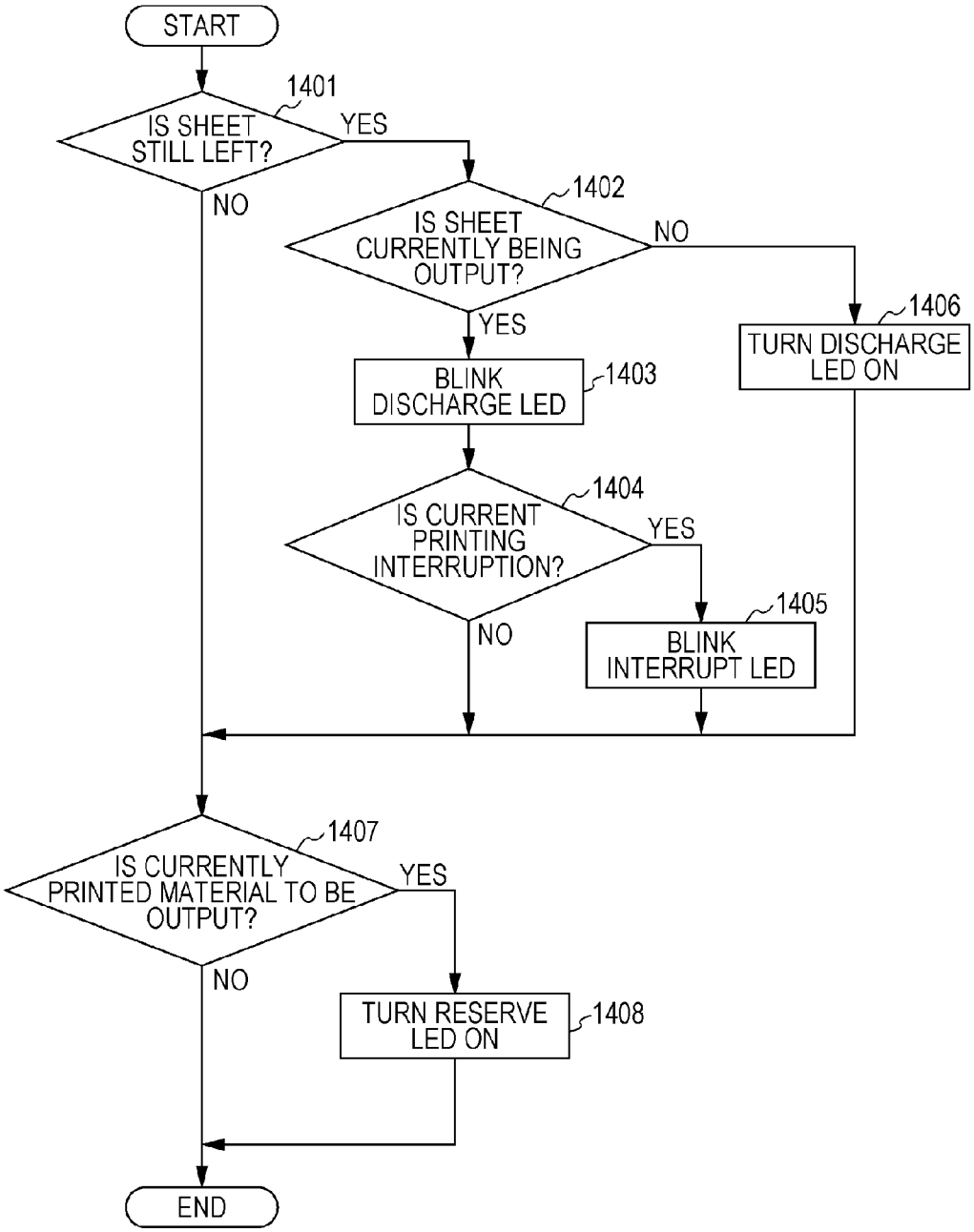
FIG. 14 is a flowchart illustrating an operation of light emitting diodes (LEDs) of each tray of the sorter unit.

As illustrated in FIG. 4, each tray of the sorter unit 114 has LEDs. FIG. 14 is a flowchart illustrating a method for controlling the LEDs. Since this control operation is executed in each tray, the operation differs depending on the state of the tray.

In STEP 1401, the control unit 108 determines whether the tray has a sheet (so whether there is at least one sheet in the tray). If the tray has a sheet, the process proceeds to STEP 1402. Otherwise, the process proceeds to STEP 1407. In STEP 1402, i.e., when the tray has a sheet, the control unit 108 determines whether a sheet is currently being output to the tray. If a sheet is not being output, the process proceeds to STEP 1406. If a sheet is being output, the process proceeds to STEP 1403. In STEP 1403, the discharge LED is blinked since the tray has a sheet and a sheet is currently being output. In STEP 1404, the control unit 108 determines whether the currently output sheet results from interrupt printing. If the sheet results from the interrupt printing, the process proceeds to STEP 1405. In STEP 1405, the control unit 108 blinks the interrupt LED. If the sheet does not result from the interrupt printing, the process proceeds to STEP 1407. In STEP 1406, i.e., when a sheet is not being output in STEP 1402, the control unit 108 turns on the discharge LED 41. In this way, it is indicated that the sheet is placed on the tray after completion of the output. The process then proceeds to STEP 1407. In STEP 1407, the control unit 108 determines whether a printed material resulting from current image formation is to be output to the tray. If the printed material is to be output, the control unit 108 turns on the reserve LED in STEP 1408 to indicate that the printed material is to be conveyed to the tray.

The flowchart of FIG. 14 illustrates the control operation for turning on/blinking the LEDs of each tray of the sorter unit 114. FIG. 15 illustrates a control method of the job LED 44.

FIG. 15 is a flowchart illustrating the control method of the job LED 44 indicating a job.

This flowchart is not for each tray but illustrates controlling of the LEDs of all trays of the sorter unit 114. In particular, this flowchart illustrates the control method for indicating a target tray when a user specifies a job through the operation unit 115 illustrated in FIG. 12.

In STEP 1501, in response to selection of a job as illustrated in FIG. 12, the control unit 108 turns on the job LEDs 44 of trays to which printed materials of the job are output. In STEP 1502, the control unit 108 blinks the job LED 44 of the tray receiving the output printed material to be collected first by the user out of the printed materials of the job. The process then proceeds to STEP 1503. In STEP 1503, the control unit 108 determines whether the user has collected the printed material from the tray (using signals from paper-presence detectors 314, 324 and 334). In STEP 1504, the control unit 108 determines whether the tray from which the printed material has been collected in STEP 1503 has the job LED 44 blinked in STEP 1502. If the printed material is collected from the tray with the blinking job LED 44, the process proceeds to STEP 1506. Otherwise, the process proceeds to STEP 1508. In STEP 1506, it is assumed that the user acts in accordance with an intention of the image forming apparatus since the printed material has been collected from the tray having the blinking LED. In STEP 1506, the control unit 108 turns off the blinking job LED 44. The process then proceeds to STEP 1507. If the printed material of the same job still remains in another tray, the control unit 108 blinks the job LED 44 of the tray from which the printed material to be collected next in STEP 1505. The process returns to STEP 1504 again. When the user collects the printed material from a tray different from the one having the blinking job LED 44 in STEP 1504, the sorter unit 114 emits an error sound (an alarm) in STEP 1508. In STEP 1509, the control unit 108 blinks the job LED 44 of the tray from which the printed material to be collected before the tray from which the printed material has been collected in STEP 1504. The process proceeds to STEP 1507. If the printed material of the same job still remains in another tray, the control unit 108 blinks the job LED 44 of the tray from which the printed material to be collected next in STEP 1505. Since the job LEDs blinked in STEPs 1509 and 1505 play the same role, blinking in STEP 1505 and blinking in STEP 1509 can be distinguished from one another by changing a blinking cycle.

By emitting an alarm indicating collection of the printed material from a storage unit other than a storage unit, indicated by a display unit, from which the printed material is to be collected, mixing up of pages of the printed material can be prevented. So the job LEDs 44 are preferably arranged to sequentially indicate the target tray for collection by e.g. blinking the relevant job LED. In addition the job LEDs 44 may be configured to simultaneously indicate the plurality of trays storing part of a job.

A second exemplary embodiment of the present invention will now be described. The second exemplary embodiment adopts the same configuration as that of the first one illustrated in FIGS. 1 to 14. In accordance with the first exemplary embodiment, the image forming apparatus informs a user of a tray from which the user collects a printed material by blinking a job LED 44 of the tray. In this exemplary embodiment, a number indicating the order of collecting the printed materials is displayed on a display unit 45 of each tray, whereby convenience is increased. Each relevant display unit 45 preferably simultaneously displays the order number. The user may use the number indicated on the display unit 45 of each storage unit storing the printed materials of the group to collect the printed materials in the required order. The job LEDs may additionally be used to sequentially indicate the target collection trays as described below with respect to FIG. 16.

Figure 16:
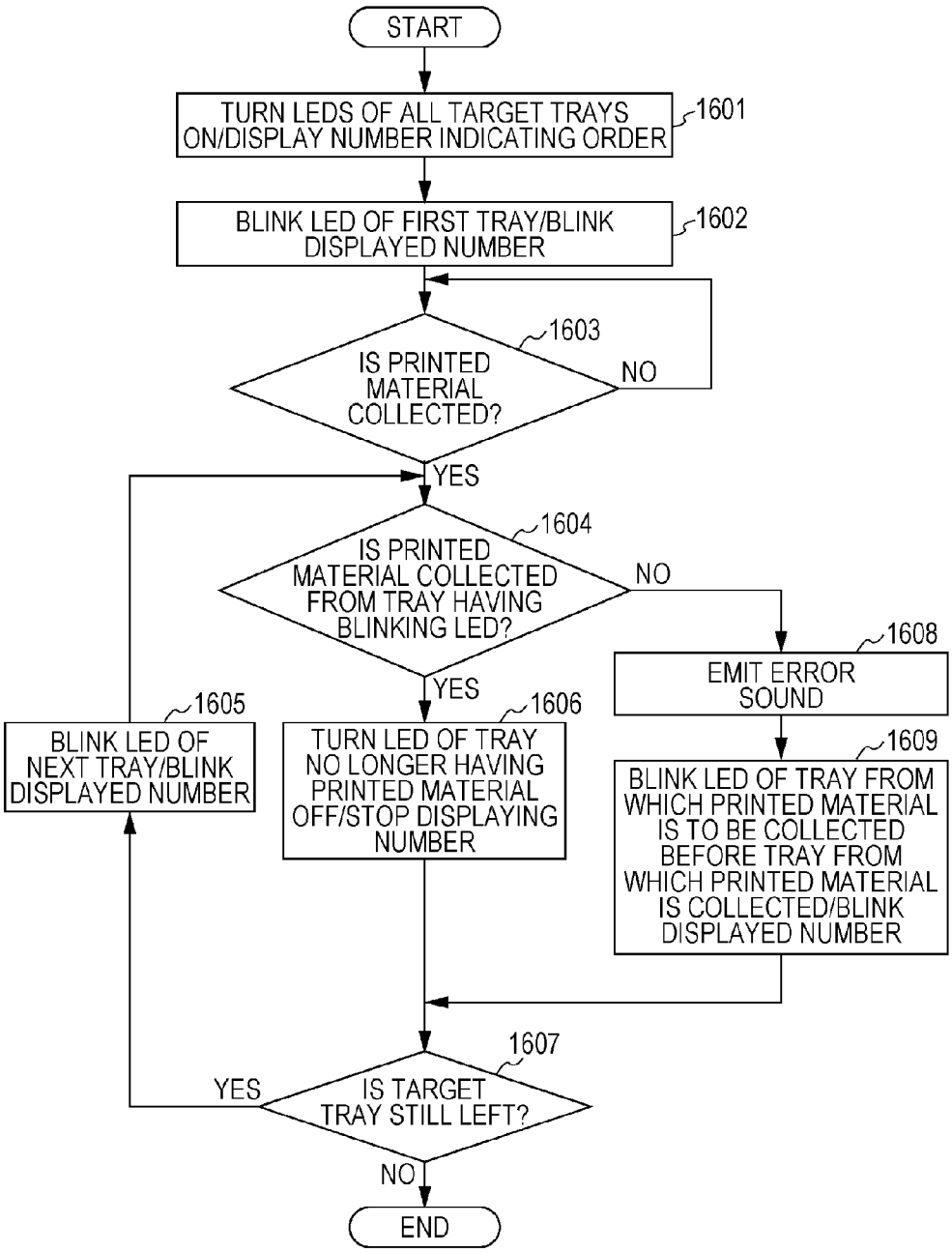
FIG. 16 is a flowchart illustrating an operation of a display unit of each tray of the sorter unit when a user collects a printed material from the tray.

FIG. 16 is a flowchart illustrating an operation of controlling the job LED 44 and the display unit 45 to indicate the order of collecting the printed materials using the display unit 45 of the tray.

In STEP 1601, in response to selection of a job as illustrated in FIG. 12, a control unit 108 turns on the job LEDs 44 of trays to which the printed materials of the job are output. The control unit assigns the order of collecting the printed materials for each tray and displays a number indicating the order in the display unit 45 of each target tray. In STEP 1602, the control unit 108 blinks the job LED 44 of the tray to which the printed material to be collected first by the user is output and blinks the number "1" displayed in the display unit 45 of the tray. The process then proceeds to STEP 1603. In STEP 1603, the control unit 108 determines whether the user has collected the printed material from the tray. In STEP 1604, the control unit 108 determines whether the tray from which the printed material has been collected in STEP 1603 has the job LED 44 blinked in STEP 1602. If the printed material is collected from the tray having the blinking job LED 44, the process proceeds to STEP 1606. Otherwise, the process proceeds to STEP 1608. In STEP 1606, it is assumed that the user acts in accordance to an intention of the image forming apparatus since the user has collected the printed material from the tray having the blinking LED. Accordingly, in STEP 1606, the control unit 108 turns off the blinking job LED 44 and the number displayed in the display unit 45. The process then proceeds to STEP 1607. If the printed material of the job still remains in another tray, the control unit 108 blinks the job LED 44 of the tray to which the printed material to be collected next is output in STEP 1605. In step 1605, the order number displayed in the blinking job LED is not changed. The process returns to STEP 1604 again. If the user has collected the printed material from a tray different from the one having the blinking job LED 44 in STEP 1604, the sorter unit 114 emits an error sound in STEP 1608. In STEP 1609, the control unit 108 blinks the job LED 44 and the number displayed in the display unit 45 of the tray storing the printed material to be collected before the one from which the printed material has been collected in STEP 1604. The process proceeds to STEP 1607. If the printed material of the job still remains in another tray, the control unit 108 blinks the job LED 44 of the tray from which the printed material is collected next. Since the job LEDs and the displayed number blinked in STEPs 1609 and 1605 play the same role, blinking in STEP 1605 and blinking in STEP 1609 is distinguished from one another by changing a blinking cycle. The order numbers displayed in the job LED 45 may be changed to new order numbers in STEP 1605.

By collecting printed materials in accordance with the order of collecting the printed materials displayed in each tray, the user can collect the printed materials from the trays in a proper order without confirming content of the printed materials. The collection order is not necessarily represented as a character like a numeral but may be a symbol or a pattern representing the order. Alternatively, a display pattern for changing the blinking speed of the LEDs stepwise may be adopted.

An embodiment of the image forming apparatus of the present invention comprises: an image forming unit (102, 105, 106) configured to form an image on a sheet and create a printed material; a plurality of storage units (310, 320, 330, 340) each configured to store the printed material created by the image forming unit; a sorter unit (114) configured to output the printed material of each group to the different storage unit; a display unit (115) configured to display an indication of the storage unit storing the printed material; and a control unit (108) configured to control the display unit, wherein, when printed materials of a group are stored in the plurality of storage units, the display unit is controlled by the control unit to display the indication of the storage unit storing the printed material to be collected first so that the printed materials collected from the plurality of storage units and piled are arranged in a page order. Preferably, when the printed materials of the group are stored in the plurality of storage units, the display unit is controlled by the control unit to display the indication of the storage unit storing the printed material to be collected first and then display the indication of the storage unit storing the printed material to be collected next after the collection of the first printed material from the indicated storage unit so that the printed materials collected from the plurality of storage units and piled are arranged in the page order.

Preferably when the printed materials of the group are stored in the plurality of storage units, the display unit is controlled by the control unit to display the indications of the plurality of storage units storing the printed materials of the group and to display the indication of the storage unit storing the printed material to be collected first differently from the indications of the other storage units.

Preferably when the printed materials of the group are stored in the plurality of storage units, the display unit is controlled by the control unit to display an order of collecting the printed materials so that the printed materials collected from the plurality of storage units and piled are arranged in the page order.

Preferably the display unit is controlled by the control unit to display the order of collecting the printed materials from the plurality of storage units using a character, a symbol, or a pattern.

Preferably the display unit displays an error when the printed material is collected from the storage unit other than the collection-target storage unit indicated by the display unit.

Preferably the sorter unit emits an alarm sound when the printed material is collected from the storage unit other than the collection-target storage unit indicated by the display unit.

Preferably the display unit is controlled to display the indication of the storage unit storing the printed material to be collected when the printed material is collect from the storage unit other than the collection-target storage unit indicated by the display unit.

Preferably when the printed materials of the group are stored in the plurality of storage units, the display unit displays a page of the printed material stored in each storage unit.

Preferably when formation of an image of a first group is suspended and an image of a second group is formed, the display unit is controlled by the control unit to display the indication of the storage unit storing a printed material having the image of the second group formed thereon.

Preferably the display unit displays an indication of a storage unit to which a result of image formation currently underway is to be output.

Preferably each storage unit includes the display unit.

Preferably the image forming apparatus further comprises: a specifying unit (115) configured to specify a group of printed materials, wherein, when the printed materials of the group specified by the specifying unit are stored in the plurality of storage units, the display unit is controlled by the control unit to display the indication of the storage unit storing the printed material to be collected first so that the printed materials collected from the plurality of storage units and piled are arranged in the page order.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-041660 filed Feb. 26, 2010, which is hereby incorporated by reference herein in its entirety.

What is claimed is:

1. An image forming apparatus comprising:

an image forming unit configured to form an image on a sheet;

a plurality of storage units each configured to store the sheets on which the image was formed by the image forming unit;

a sorter unit configured to sort sheets which belong to one print group and on each of which an image is formed;

a display unit configured to display the storage unit in which the first or the last sheet of said one print group has been stored; and a control unit configured to cause the apparatus to indicate an error in a case where the sheet sorted to the storage unit other than the storage unit displayed by the display unit is removed and to cause the display unit to again display the storage unit in which the first or the last sheet has been stored.

2. The image forming apparatus according to claim 1, wherein, the display unit is further configured to display an indication of the storage unit storing a next sequential portion of the group of printed sheets.

3. The image forming apparatus according to claim 1, wherein the display unit is configured to display indications of the plurality of storage units storing the portions of the group and to display the indication of the storage unit storing the portion to be collected first differently from the indications of the other storage units.

4. The image forming apparatus according to claim 1, wherein the display unit is configured to display an order of collecting the plurality of portions of the group such that they are collected in sequential order.

5. The image forming apparatus according to claim 4, wherein the display unit is configured to display the order of collecting the portions from the plurality of storage units using a character, a symbol, or a pattern.

6. The image forming apparatus according to claim 1, further comprising:

a sheet presence detecting unit for detecting the presence of a sheet or sheets in each storage unit.

7. The image forming apparatus according to claim 6, wherein the display unit is configured to display an indication of the storage unit storing the next sequential portion of the group of printed sheets in the case that the sheet presence detecting unit detects the removal of the portion from the first indicated storage unit.

8. The image forming apparatus according to claim 6, further comprising:

a sound emitting unit wherein the sound emitting unit is configured to emit an alarm sound in the case that the sheet presence detecting unit detects the removal of sheets from a storage unit other than the storage unit indicated by the display unit.

9. The image forming apparatus according to claim 6, wherein the display unit is configured to display the indication of the storage unit storing the portion to be collected in the case that the sheet presence detecting unit detects the removal of sheets from a storage unit other than the storage unit indicated by the display unit.

10. The image forming apparatus according to claim 1, wherein the display unit is configured to display a pictorial of a page of the printed material stored in each storage unit.

11. The image forming apparatus according to claim 1, wherein, when formation of an image of a first group is suspended and an image of a second group is formed, the display unit is configured to display an indication of the storage unit storing a printed material having the image of the second group formed thereon.

12. The image forming apparatus according to claim 1, wherein the display unit is configured to display an indication of a storage unit to which a result of image formation currently underway is to be output.

13. The image forming apparatus according to claim 1, wherein each storage unit includes another display unit.

14. The image forming apparatus according to claim 1, further comprising:

a specifying unit configured to specify a group of printed sheets in response to a user instruction, wherein, the display unit is configured to display an indication of the storage unit storing the portion including the first or the last sheet of the group such that a user is directed to collect the portion from the indicated storage unit first.

* * * * *